United States Patent [19]

Swiatosz et al.

[11] Patent Number: 4,547,656

[45] Date of Patent: Oct. 15, 1985

[54] PORTABLE SMOKE GENERATOR

[75] Inventors: Edmund Swiatosz, Maitland; Paul D. Grimmer, Winter Park, both of Fla.

[73] Assignee: The United States of America as represented by the Secretary of the Navy, Washington, D.C.

[21] Appl. No.: 597,892

[22] Filed: Apr. 9, 1984

[51] Int. Cl.[4] ..... H05B 1/00; H05B 3/00; F24H 1/14

[52] U.S. Cl. ..... 219/300; 219/272; 252/359 CG; 422/305

[58] Field of Search ..... 219/300, 296, 272, 273, 219/275, 304, 305; 252/359 CG, 305, 359 R; 43/127; 434/226; 426/314, 315, 312, 232; 99/467, 471, 473, 475, 476, 481, 482

[56] References Cited

U.S. PATENT DOCUMENTS

| | | | |
|---|---|---|---|
| 3,234,357 | 2/1966 | Seuthe | 219/300 X |
| 3,658,719 | 4/1972 | McConnaughey | 252/305 X |
| 3,990,987 | 11/1976 | Rogers | 252/359 A |
| 4,182,688 | 1/1980 | Murtaugh | 252/305 |
| 4,303,397 | 12/1981 | Swiatosz | 434/226 |
| 4,326,119 | 4/1982 | Swiatosz | 219/272 |
| 4,493,211 | 1/1985 | Weinstein | 73/147 |

*Primary Examiner*—Roy N. Envall, Jr.
*Assistant Examiner*—M. M. Lateef
*Attorney, Agent, or Firm*—Robert F. Beers; Robert W. Adams

[57] ABSTRACT

A resistance tube type smoke generator utilizes a plurality of tube sections, each having a distinct cross-sectional area and electrical resistivity to provide both storage and vaporization via prolonged differential heating of a smoke producing agent. Thermal control may be exercised by sensing change in resistivity of the entire tube or by thermostatic sensors attached to the tubing sections.

12 Claims, 8 Drawing Figures

FIG. 1(a)
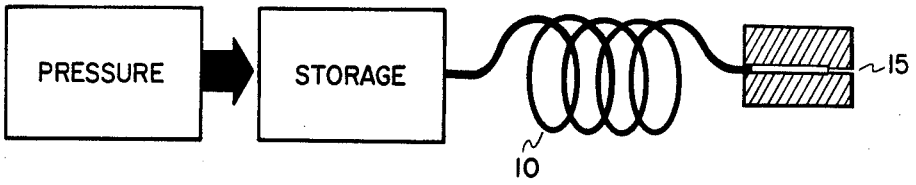
FIG. 1(b)
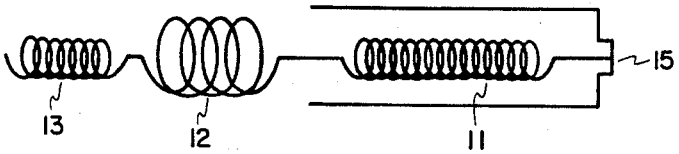
FIG. 1(c)
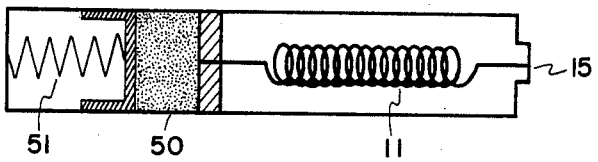
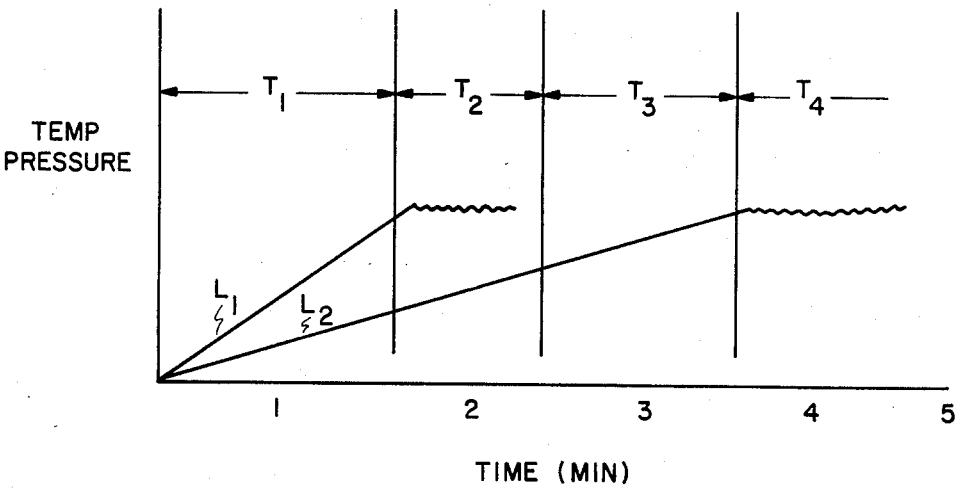
FIG. 2

PORTABLE SMOKE GENERATOR

BACKGROUND OF THE INVENTION

This invention relates to the field of smoke generators, and in particular to portable smoke generators for use as training devices. More particularly, the invention relates to smoke generators wherein a smoke producing agent passes through thermally conductive coils and is thus heated to produce smoke. In still greater particularity, the invention may be described as a smoke generator having a series of thin walled tubular coils which also serve as electric current conductors and hence produce differential heating to prolong duration of smoke generation, each coil having a cross-sectional area, length, and electrical resistance selected to provide storage of, motive forces to, and heat transfer to, a smoke producing liquid contained therein.

Training of personnel in emergency response procedures, such as firefighting, is a continual process of particular importance to those engaged in maritime commerce, public safety, and the armed services, especially the Navy. Small smoke generators currently available are not acceptable for shipboard training or training in confined structures such as barracks or dormitories. The Mark 7 smoke pot is the standard military pyrotechnic smoke generator, and a 3-minute smoke bomb made by the Superior Signal Co. is also used. These are disposable non-resuable units which can be quite expensive. Commercial smoke generators which are electrically operated are available, but are too large for surprise drills, and are generally of low capacity due to lack of effective thermal design.

The portable smoke generator of U.S. Pat. No. 4,326,119 is the closest prior art, it being the experimental predecessor of the instant invention; however, it has been determined that for effective training, a smoke must be generated for a greater length of time than was possible with the battery operated generator. Other smoke generators have been devised, such as those disclosed in U.S. Pat. Nos. 3,234,357; 3,990,987; and 3,891,826, which have some characteristics common to the instant invention due to the immutable principles of thermodynamics and fluid flow; however, these generators are generally designed for special purpose applications. Therefore, their design and function are somewhat inappropriate for the instant device, which is believed to provide a patentably improved smoke generator.

SUMMARY OF THE INVENTION

The current invention overcomes some of the prior problems, in that it is a small portable smoke generator capable of generating a smoke over a prolonged period of time, and is easily and conveniently put into operation wherever an AC outlet is available.

Generally the generator is of the resistance tube type, in that an electrical current passing through the resistance tube is used to heat a coiled tubing containing a smoke producing agent, thereby generating smoke. In its simplest form, the generator has distinct tubing sections, each section having a different cross-sectional area and differnt electrical characteristics, thus providing for a variation of fluid volume and heat transfer among the sections. The first section, a heater section, has the smallest diameter and the highest electrical resistance, thus generates the most heat per unit area. It is also the longest section and is disposed within the generator, having one end communicating with the outlet to the atmosphere and the opposite end connected to the second section, also called the storage section. The storage section is of the largest cross-sectional area and internal volume of the three sections, but has the lowest electrical resistance and generates the least heat per unit area. Connected between an input orifice and said storage section is a third section, also called a pump section. The pump section is of intermediate cross-sectional area and electrical resistance, and serves to force the fluid from the storage section by the thermal activity within the smoke agent in this section.

The various electrical resistances of the tubular sections are advantageously employed by an electrical current passing through the entire length of the tube and generating heat in accordance with the $I^2R$ relationship for each section of tubing. A thermostat is employed in relation to the heater section or both the heater and the pump section to ensure proper temperature control within the coiled tubes.

It is an object of the present invention to provide a reusable smoke producing device for training purposes.

A further object of the invention is to provide a portable smoke producing device utilizing a tubular coil of varying electrical resistance and cross-sectional area for generating a smoke from a smoke producing liquid contained within said tubular coil.

Another object of the invention is to provide a smoke producing device capable of generating a volume of smoke at any location in a structure proximal an electrical outlet for testing and training personnel in emergency response measures.

These and other objects, features and advantages of the invention will become apparent to the artisan by reference to the following detailed description when considered with the accompanying drawings.

BRIEF DESCRIPTION OF THE DRAWINGS

FIGS. 1(*a*), 1(*b*) and 1(*c*) illustrate the mechanical aspect of the invention;

FIG. 2 is a graphic pictorial of the interaction of the sections;

FIG. 5(*b*) illustrates a second alternative control circuit.

DESCRIPTION OF THE PREFERRED EMBODIMENT

With reference to FIG. 1(*a*), it should be clear that in smoke generators of the heater tube type, a smoke producing fluid is stored in some manner until such time as is desirable for the production of smoke. The heater tube is then elevated in temperature either directly through the application of an electric current or by conduction from a heat source. The fluid is forced through the heater tube by the application of force in the form of direct pressure or capillary action, wherein the fluid absorbs the heat thereof and is expelled through an orifice to create a "smoke".

FIG. 1(*b*) illustrates the "plumbing" of the instant invention. The electrically conductive tubing has a heater section 11 which has a relatively high resistance, therefore generating high $I^2R$ heating. This energy is transferred to the smoke producing agent within the tube, resulting in vaporization of the smoke producing agent within heater section 11. The vaporized smoke producing agent is discharged from heater section 11 to form the smoke in the open atmosphere. Connected to heater section 11 is a storage section 12 which has a large cross-sectional area relative to heater section 11 and also has a very low electrical resistance, thus very little $I^2R$ heating is generated in this area. In order to insure that the smoke agent stored in storage section 12 is transferred to heater section 11, a pump section 13 is provided which has a cross-sectional area intermediate heater and storage sections and an electrical resistance sufficient to generate enough $I^2R$ heating to increase the pressure on the stored smoke agent in pump section 13 and storage section 12, thus urging the smoke producing agent toward heater section 11.

The electrical resistance of the three sections is determined from the relationship:

$$r=\rho(L/A),$$

where r is the resistance, $\rho$ is the resistivity of the material,

L is the length of the tubing, and

A is the end face area of the tubing.

Figure 3:
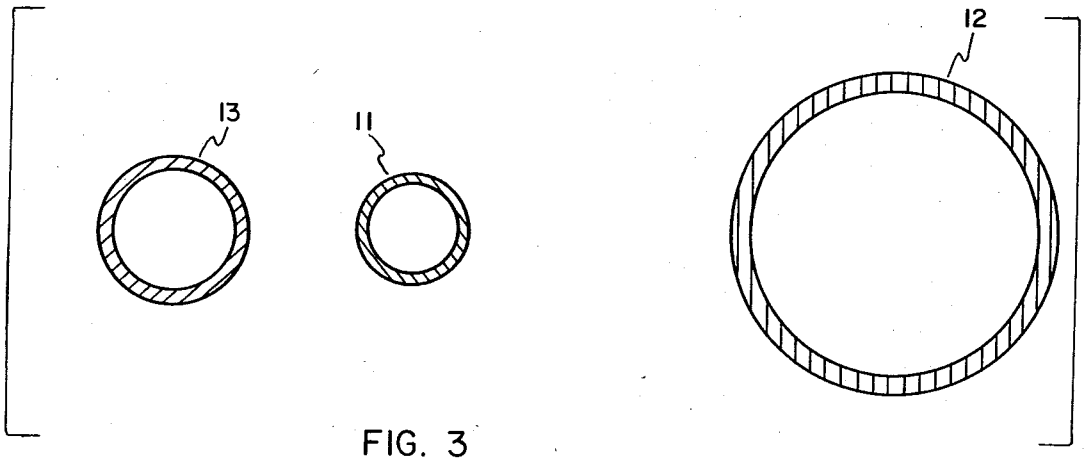
FIG. 3 is a cross-sectional view of the tubing sections.

FIG. 3 depicts a cross-sectional view of each of the sections of tubing, wherein: pump section 13 is ⅛" tubing having a wall thickness of 0.008" and a length of 21 feet; heater section 11 is 3/32" tubing having a wall thickness of 0.006" and a length of 31 feet; and storage section 12 is ¼" tubing with a wall thickness of 0.015 and a length of 12 feet. With these dimensions there will be approximately fifty times the $I^2R$ heating energy per unit volume of smoke producing agent available for transfer to the fluid in heater section 11 as in storage section 12, and about three times as much in heater section 11 as in pump section 13.

FIG. 2 illustrates the interaction of the various sections in the production of smoke for an ideal design for a smoke generator having an output lasting five to seven minutes. During $T_1$, heater section 11 and pump section 13 begin heating as the electrical current passes through the coil, thereby increasing the pressure and temperature within the coil. At the end of $T_1$ heater section 11 has reached the temperature necessary to vaporize the smoke producing agent and enough pressure has been generated to overcome the pressure relief disk 14, shown in FIG. 4, covering the orifice 15 and the smoke generator begins emitting "smoke" from the smoke producing agent within heater section 11. During $T_2$ "smoke" is continually discharged from orifice 15 due to the vaporization of the smoke producing agent initially stored in heater section 11, and smoke producing agent from storage section 12 is forced into heater section 11 due to the increase in temperature and pressure in pump section 13. During $T_3$, the "smoke" is produced from the smoke producing agent initially stored in section 12. During $T_4$, the smoke produced by the fluid from pump section 13 is discharged, having been vaporized by either the pump section or the heater section.

Figure 4:
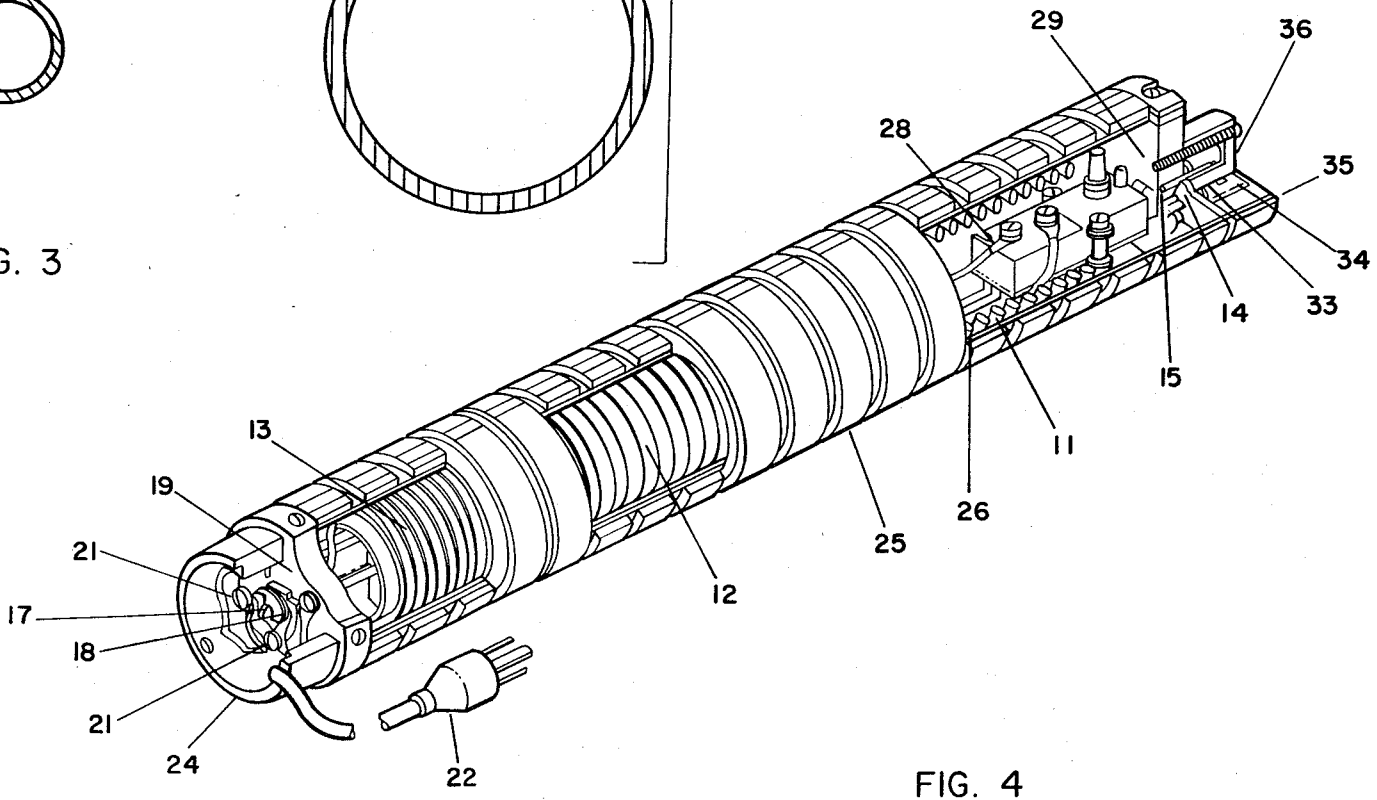
FIG. 4 is a cutaway view showing the alignment of the tubing.

With principle of operation understood, reference to FIG. 4 will illustrate the device in its complete form. Pump section 13 terminates in a threaded fitting 17 sealable by a threaded nut 18. Fitting 17 is held in a central aperture of a filler end plate 19 through which a current path is formed by electrically conductive bolts 21 which penetrate plate 19 and are operably connected to an AC line plug 22. Removably affixed to plate 19 is a filler end enclosure 24 which covers bolts 21 and fitting 17 and provides electrical and thermal insulation therefrom. Line plug 22 is connected to bolts 21 via an aperture in filler end enclosure 24. Plate 19 seals the filler end of a tubular housing 25 which extends the length of the tubing and encloses the same. An insulating sleeve 26 lines the inside of tubular housing 25 and separates said housing 25 from the tubing. A thermostat 28 is cooperatively mounted paraxially within the coiled tubing so as to monitor the temperature of heater section 11 near orifice 15. Thermostat 28 is electrically connected between heater section 11 and conductive bolts 21, and opens the electrical path therebetween when a pre-established temperature is established. The opposite end of the tubing, pump section 13, is electrically connected to conductive bolts 21 to complete the circuit path.

Orifice 15 is mounted in and extends through an orifice end plate 29 which serves to seal the orifice end of tubular housing 25. Pressure relief disk 14 closes orifice 15. Disk 14 may be a heat fusible disk or a pressure sensitive disk, and may be secured over orifice 15 by a retaining sleeve 33 held in place by a retaining sleeve cap 34. An orifice end enclosure 35 having an aperture 36 for the discharge of smoke from orifice 15 is detachably affixed to orifice end plate 29.

Figure 5:
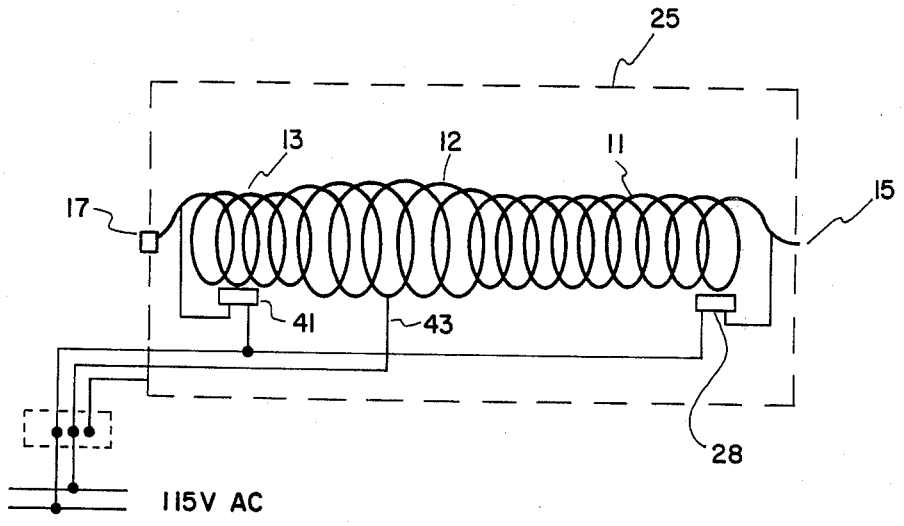
FIG. 5(*a*) illustrates a first alternative control circuit.
Figure 5:
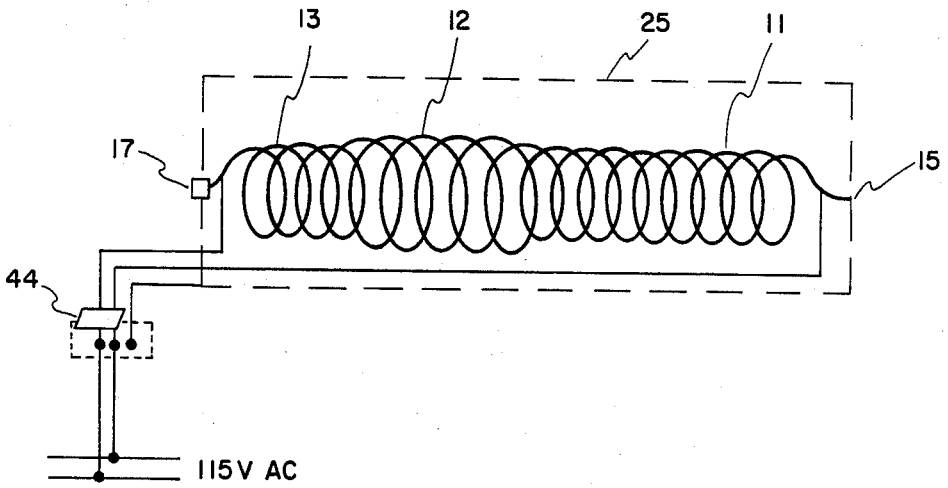

Alternatively, a more flexible control of pressure buildup in the pump coil may be achieved by the use of a control circuit as shown schematically in FIG. 5(*a*). FIG. 5(*a*) illustrates a separate pump control circuit utilizing pump coil 13 and an associated thermostat 41, said pump control circuit sharing a common return 43, located at storage section 12, with a heater control circuit utilizing heater section 11 and thermostat 28. Independent control over the pump and heater sections allows power to be generated in pump section 13 to match the power dissipation in heater section 11, thus immediately raising the pressure in pump section 13 to insure that the smoke agent in storage section 12 is forced into heater section 11. Furthermore, thermostat 28 would be adjusted to an appropriate temperature setting to provide the quality of smoke desired and thermostat 41 would be adjusted to control the desired pressure and flow-rate, thereby providing some measure of adjustment to the duration of the smoke output.

Yet another alternative employs a controller such as the AD7 controller manufactured by Fluid Kinetics, Inc., which is of the type shown in U.S. Pat. Nos. 4,086,466 and 3,524,968. Controller 44 utilizes the resistivity of the coiled tubing as a function of temperature in order to control the current flow through the entire coil. The device replaces thermostat 28 in the first embodiment described hereinabove, and could replace both thermostats 28 and 41 in the first alternative embodiment described. As shown schematically in FIG. 5(*b*), controller 44 is preferably mounted remotely from the smoke generator itself, for example, at the plug of line plug 22. It should be noted that since controller 44 works on the basis of the change in resistance as a factor of temperature, the selection of metals used in the tubing is reduced. For example, the dimensions given for the tubing section illustrated in FIG. 3 were for tubing made of a nickel alloy called C-276, a product of the Superior Tube Company of Norristown, Pa. This alloy allows the smoke generator to be manufactured in a much more compact package than stainless steel; however, it is not suitable for use with the AD7 because of a low variation of resistivity as a function of temperature, therefore stainless steel would be used with the AD7 and thus require a slightly larger packaging.

With the tubing configuration as given herein, a smoke can be produced for up to five to seven minutes if the heater section 11 is 3/32" in diameter and 31' in length, the storage section 12 is ¼" in diameter and 12' in length, and pump section 13 is ⅛" in diameter and 21' in length. Devices for generating smoke for a longer period of time may be constructed using the controls of the first described embodiment or the second alternative thereto and substituting for pump section 13 and storage section 12 with a reservoir 50 and a mechanical means 51 such as a spring or air pressure as shown in FIG. 1(*c*).

It is to be understood that the preceding description is given by way of illustration and is not intended to limit the invention, which may be practiced otherwise than as specifically described herein within the scope of the appended claims.

What is claimed is:

1. An apparatus for generating smoke, comprising in combination:

electrically conductive tubing configured as a coil and having a plurality of sections having distinct $I^2R$ heating properties and cross-sectional areas;

means for applying an electric current across the length of said tubing;

housing means for containing said tubing having a first aperture communicating with said tubing for discharge of smoke and a resealable aperture communicating with said tubing for insertion of smoke producing liquids, said housing providing electrical and thermal insulation about said tubing;

a destructable relief disk located in said first aperture providing means for discharging smoke; and means for controlling the temperature of said tubing operably connected thereto.

2. The apparatus of claim 1 wherein said electrically conductive tubing comprises:

a heater section communicating with said first aperture, having a high electrical resistance and a cross-sectional area smaller than the remainder of said tubing;

a storage section serially communicating at one end with said heater section, having a low electrical resistance and a cross-sectional area larger than the remainder of said tubing; and a pump section communicating with said resealable aperture and serially connected to said storage section, having electrical resistance and cross-sectional area intermediate said heating and storage section.

3. The apparatus of claim 2 wherein said means for applying an electric current comprises:

an alternating current input line adaptively configured to receive an alternating electrical current providing a current path serially through said pump section, storage section, and heater section.

4. The apparatus of claim 3 wherein said means for controlling the temperature of said tubing comprises a thermostat operably connected to open said current path in response to the temperature of said heater coil.

5. The apparatus of claim 3 wherein said means for controlling the temperature of said tubing comprises means for dynamically sensing the variation in resistivity of tubing as a function of temperature and interrupting current flow thereto in accordance with a predetermined temperature level, operably connected to sense resistivity variations along the entire tube.

6. The apparatus of claim 5 wherein said means for controlling the temperature of said tubing futher comprises means for varying said predetermined temperature level, operably located distal to said tubing.

7. The apparatus of claim 2 wherein said means for applying an electrical current comprises an AC input line providing a parallel current path across said pump section and said heater section, said AC line being connected to said tubing at the center of said storage line and at the ends of said pump and heater sections distant thereto.

8. The apparatus of claim 7 wherein said means for controlling the temperature of said tubing comprises:

a first thermostat operably connected to sense the temperature of said pump section and to interrupt the current path therethrough in accordance with a predetermined temperature level; and a second thermostat operably connected to sense the temperature of said heater section and to interrupt the current path therethrough in accordance with a predetermined temperature level.

9. The apparatus of claim 2 wherein said housing means comprises:

an enclosure tube for containing said tubing and said temperature controlling means;

a filler end plate operably connected to said enclosure tube, having means for providing electrical connections and having a central aperture containing a threaded sleeve connected to said pump section;

a filler end plate threadably mated to said threaded sleeve;

a filler end enclosure detachably affixed to said filler end plate covering said filler end plate and said electrical communicating means, having an aperture therethrough for provision of electrical power;

an orifice end plate affixed to said enclosure tube having an orifice communicating with said heater section;

relief disk retaining means affixed to said orifice end plate; and orifice end enclosure detachably affixed to said orifice end plate having an aperture therethrough for the discharge of smoke.

10. The apparatus of claim 1 further comprising means for urging smoke producing agent through said tubing towards said first aperture.

11. The apparatus of claim 10 further comprising a reservoir for containing a smoke producing fluid, operably connected to said tubing to admit fluid thereto in response to said urging means.

12. The apparatus of claim 11 wherein said means for urging comprises a spring driven piston, located within said reservoir and compressed by the induction of said smoke agent.

* * * * *